US006851987B2

(12) United States Patent
Mase et al.

(10) Patent No.: US 6,851,987 B2
(45) Date of Patent: Feb. 8, 2005

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/722,671

(22) Filed: Nov. 26, 2003

(65) Prior Publication Data

US 2004/0106330 A1 Jun. 3, 2004

(30) Foreign Application Priority Data

Nov. 27, 2002 (JP) ..... 2002-343697

(51) Int. Cl.[7] ..... H01R 13/514
(52) U.S. Cl. ..... 439/752
(58) Field of Search ..... 439/595, 752

(56) References Cited

U.S. PATENT DOCUMENTS 5,037,336 A * 8/1991 Betsui ..... 439/752
5,645,453 A 7/1997 Yamaguchi
5,713,760 A 2/1998 Chemin
5,722,857 A * 3/1998 Saito et al. ..... 439/595
5,782,658 A * 7/1998 Maegawa et al. ..... 439/595
6,048,226 A * 4/2000 Iwahori ..... 439/595
6,193,551 B1 * 2/2001 Yamamoto et al. ..... 439/595
6,652,328 B2 * 11/2003 Suzuki ..... 439/752

FOREIGN PATENT DOCUMENTS

JP 2001-160444 of 2001

* cited by examiner

*Primary Examiner*—Thanh-Tam Le
(74) *Attorney, Agent, or Firm*—Gerald E. Hespos; Anthony J. Casella

(57) ABSTRACT

A male housing (30) has a receptacle (32) that surrounds a front part of a terminal accommodating portion (31). A moving plate (40) is mountable on the front surface of the terminal accommodating portion (31) and has through holes (41) through which tabs (16) of male terminals (5) are passed. The moving plate (40) has a front view obtained as if by cutting off part of the cross section of the receptacle (32) to avoid an upside-down insertion preventing rib (39) of a female housing (20). Guide ribs (45) of square cross section and guide ribs (46) of hooked cross section are formed on the moving plate (40) and extend forward and backward. Guide grooves (51, 52) of similar cross sections are formed in the receptacle (32) extend forward and backward to slidably engage the guide ribs (45, 46).

16 Claims, 14 Drawing Sheets

CONNECTOR

BACKGROUND OF THE INVENTION

1. Field of the Invention

The invention relates to a connector with a front member that is mountable on the front surface of a terminal accommodating portion.

2. Description of the Related Art

Japanese Unexamined Patent Publication No. 2001-160444 discloses a female connector that was developed in response to a demand to miniaturize connectors. The connector shown in Japanese Unexamined Patent Publication No. 2001-160444 has a housing with cavities for receiving terminal fittings. The housing is formed without a front wall to ensure sufficient margins for a mold to form locks and walls in the cavities. The front wall is formed separately and is mounted later.

A front wall also can be formed separately on a male connector. A housing of a male connector normally has a receptacle to surround a front part of a terminal accommodating portion where cavities are formed. Male terminals are inserted into the cavities so that tabs of the terminals project into a receptacle of the housing. Thus, a separate front wall is inserted to the back of the receptacle and is mounted on the terminal accommodating portion.

The front wall can be inserted smoothly to the back of the receptacle if the front wall has cross section shaped to fit closely in the receptacle. The front wall may have a cross section obtained as if by cutting off part of the cross section of the receptacle. For example, FIG. 14 shows a housing 1 of a male connector. A receptacle 2 projects from the housing 1 and a rib 3 is at a specified position on an inner surface of the receptacle 2 to enable a housing of a mating female connector to fit in the receptacle in a proper orientation. The housing of the female connector is fit so that the rib 3 aligns with an escape groove in the outer peripheral surface of the mating female housing.

Several male housings 1 may have similar constructions. However, the position of the rib 3 for preventing the upside-down insertion may change to the opposite side as shown in phantom in FIG. 14 depending on the kind of the connector. The front wall may have a cross section to fit closely into the receptacle 2, and different kinds of front walls may be formed with the escape grooves at different positions to enable the corresponding ribs 3 to escape. The front wall conforms to the different positions of the ribs 3. However, this is disadvantageous in terms of production costs.

The front wall 4 has a cross section obtained as if by cutting off part of the cross section of the receptacle 2 to avoid interference with an area where the rib 3 is provided, as shown in FIG. 14. Thus, the front wall can be used commonly for different male housings 1 where the ribs 3 are at different positions.

A front wall 4 that has a cross section obtained as if by cutting off a part of the cross section of the receptacle 2 cannot be inserted smoothly into the receptacle 2, and more time is needed to mount the front wall 4.

The invention was developed in view of the above problems and an object thereof is to enable a front member to be easily and precisely mounted.

SUMMARY OF THE INVENTION

The invention relates to a connector with a housing that has a terminal accommodating portion with at least one cavity for accommodating at least one terminal fitting. A receptacle surrounds a front part of the terminal accommodating portion, and a separate front member is insertable into the receptacle and onto the front surface of the terminal-accommodating portion. At least one guiding means is provided between the front member and the receptacle for guiding the front member substantially parallel with the longitudinal direction of the terminal fittings in the receptacle.

The guiding means guides the front member smoothly to the front surface of the terminal-accommodating portion in the receptacle without shaking. Thus, the front member can be mounted easily and precisely.

The separate front member preferably forms at least part of front ends of the cavities.

The guiding means may comprise at least one rib and at least one groove disposed on the front member and the receptacle for slidable engagement. Thus, the front member can move smoothly. Plural guiding means preferably are provided and may have different respective cross sections. The rib and the groove are not engageable unless the front member is inserted in a proper posture. As a result, an improper posture of the front member can be detected.

A mating housing preferably fits into the receptacle of the housing.

A rib or a groove preferably is formed on an outer surface of the mating housing and slidably engages the groove or the rib of the guiding means formed on the inner surface of the receptacle.

A shake-preventing portion may be disposed to become active only towards the end of the insertion stroke of the mating housing into the receptacle. For example, the shake-preventing portion may be at a rear end of the rib or groove of the mating housing with respect to the inserting direction. Thus, the shake-preventing rib or groove may engage the mating groove or rib at a final stage of the connecting operation to prevent shaking and to avoid abrasion caused by fine sliding motions of the terminal fittings. The engagement of the shake-preventing portions at the final stage of the connecting operation ensures a low force to connect the housings.

The housing preferably is a male housing with at least one male terminal inserted into the cavity while a tab thereof projects into the receptacle. The front member preferably is a moving plate with at least one through holes through which the tab is passed. The moving plate is locked partly in the receptacle with leading end of the tab in the corresponding through hole. Thus, the moving plate is moved towards the back side of the receptacle as a mating female housing is fit into the receptacle.

The moving plate is moved substantially straight in the receptacle while letting the tab pass through the through hole. Thus, the moving plate aligns the tabs while the two housings are being connected.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
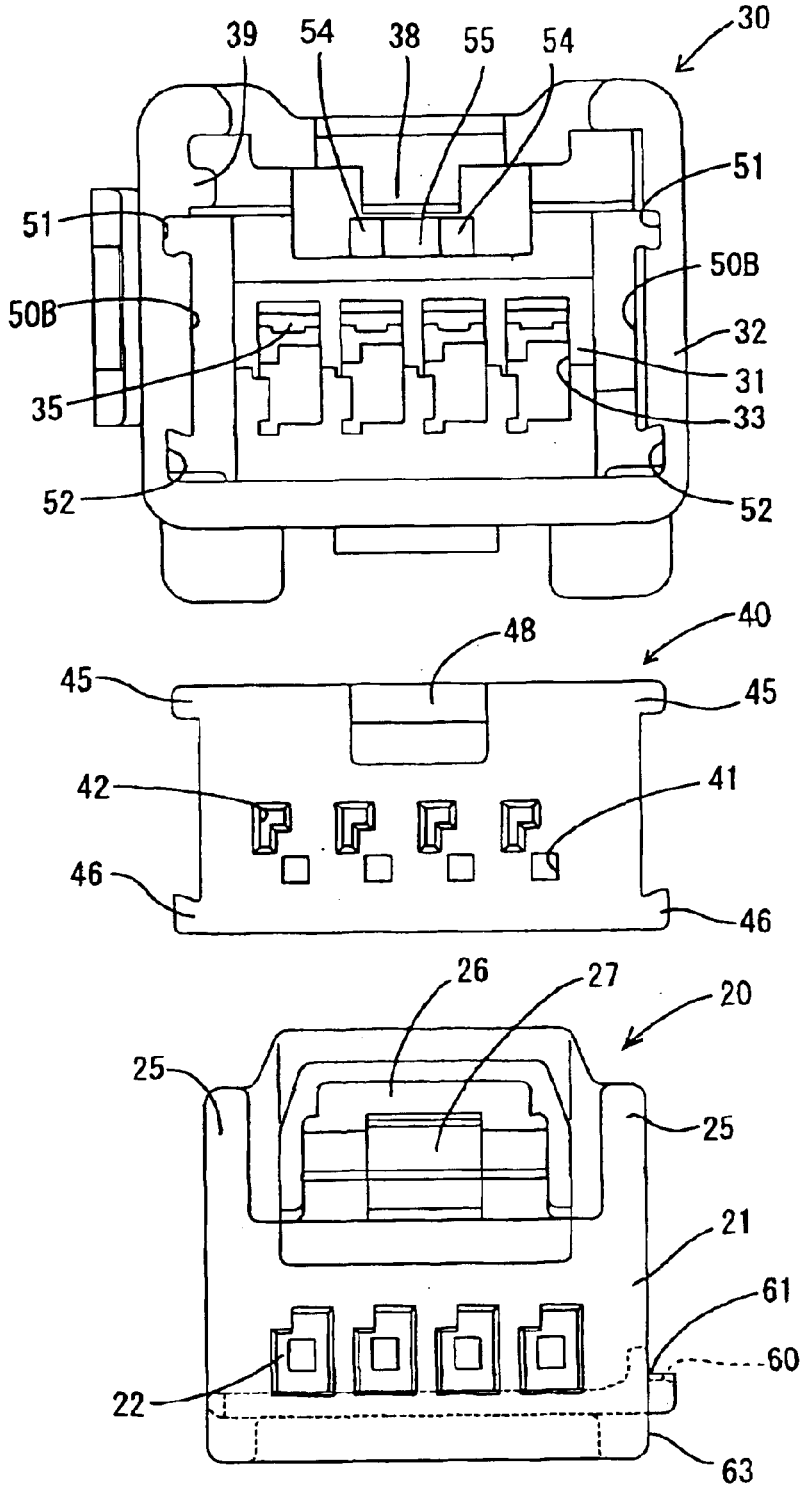
FIG. 1 is front views of a male housing and a moving plate and a rear view of a female housing according to one embodiment of the invention.
Figure 2:
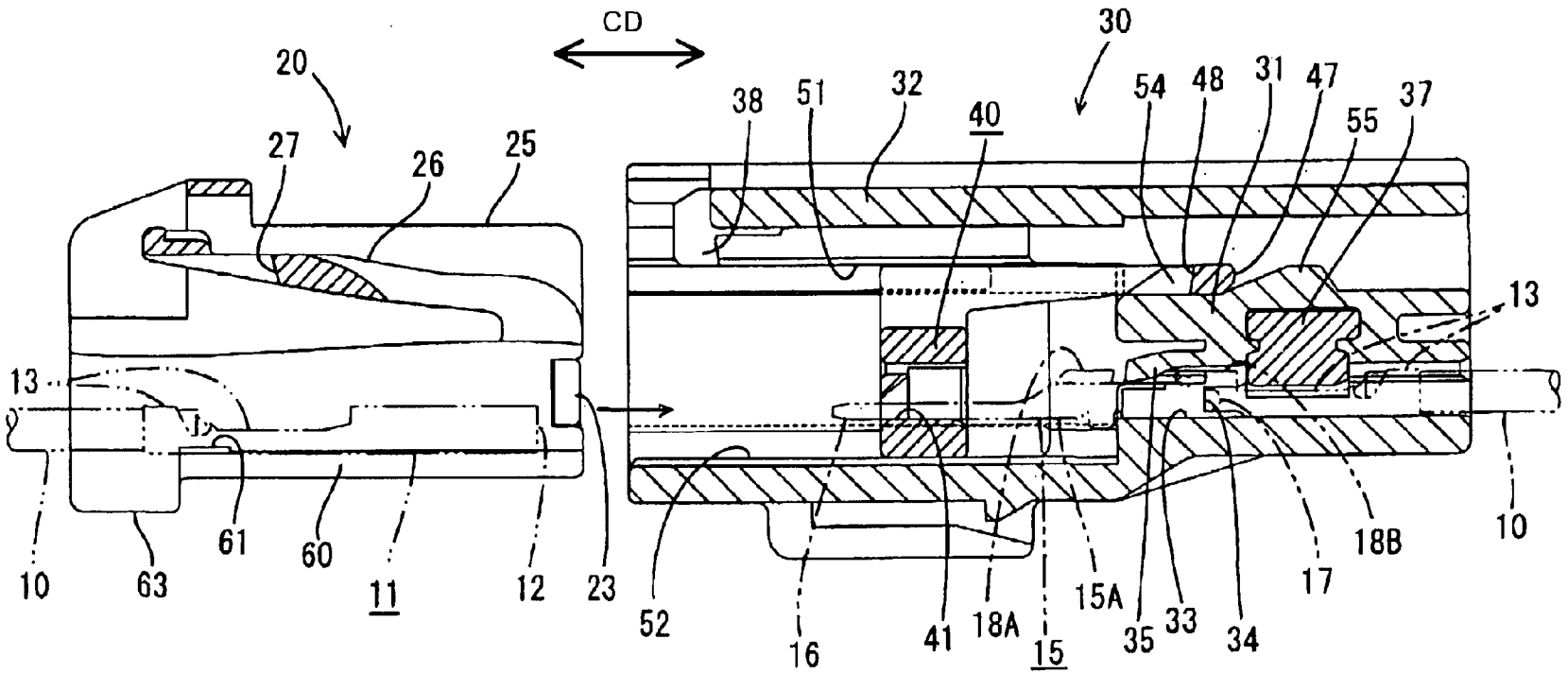
FIG. 2 is a longitudinal section showing a state before the male and female housings are connected.

A connector according to the invention has female and male housings 20 and 30 that are connectable with each other along a connecting direction CD as shown in FIGS. 1 and 2. In the following description, mating sides of the housings 20, 30 are referred to as the front side.

The female housing 20 is made e.g. of a synthetic resin and includes a wide terminal-accommodating portion 21. Four cavities 22 are formed substantially side-by-side in the terminal-accommodating portion 21 and a female terminal 11 is accommodated in each cavity 22. Each female terminal 11 has a front end formed into a substantially rectangular tubular connecting portion 12. A barrel 13 is formed at a rear end of the female terminal fitting 11 and is crimped, bent or folded into connection with a wire 10.

The female terminal 11 is inserted into the corresponding cavity 22 from behind (from the left in FIG. 2) and is locked initially by a lock (not shown) in the cavity 22. A retainer 23 then redundantly locks all of the female terminal fittings 11 (see FIG. 3). The retainer 23 is formed with terminal insertion openings 24 that align with the respective cavities 22.

Left and right protection walls 25 stand on the upper surface of the terminal-accommodating portion 21, and a resiliently deformable lock arm 26 is formed between the protection walls 25. The lock arm 26 is cantilevered back along the connecting direction CD from the front of the terminal-accommodating portion 21 and can lock the housings 20 and 30 in their properly locked state. A locking hole 27 is formed near the free end of the lock arm 26.

The male housing 30 also is made e.g. of a synthetic resin. The male housing 30 has a terminal-accommodating portion 31 and a receptacle 32 is formed on the front surface of the terminal-accommodating portion 31, as shown in FIGS. 1 and 2. The receptacle 32 is configured to closely receive the female housing 20 including the protection walls 25 and the lock arm 26. The upper surface of the receptacle 32 extends to the rear end of the terminal-accommodating portion 31 and defines a clearance to the upper surface of the terminal-accommodating portion 31.

Cavities 33 are formed side-by-side in the terminal-accommodating portion 31 for receiving male terminals 15. Each male terminal 15 has a tab 16 that projects at the leading end of a main body 15A. A barrel 13 is provided at a rear end and is configured for crimped connection with a wire 10.

Figure 4:
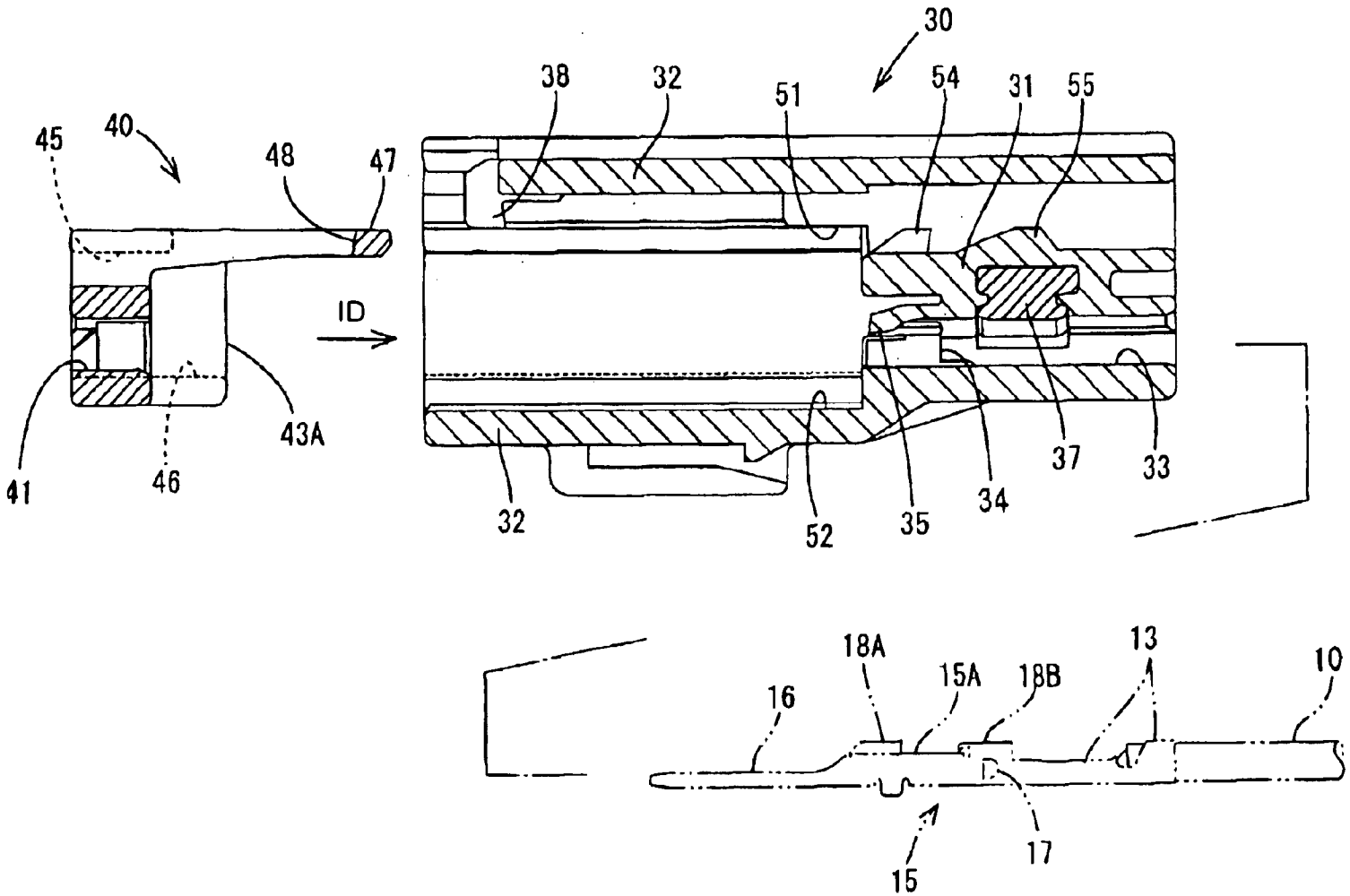
FIG. 4 is a longitudinal section showing an operation of mounting the moving plate.

The male terminal 15 is inserted into the corresponding cavity 33 from behind (from the right in FIG. 4). However, a contact 17 projects from one side surface of the main body 15A and abuts a stopper recess 34 in a side wall of the cavity 33 to stop the male terminal at a front limit position. Additionally, a lock 35 is formed at the ceiling wall of the cavity 33 and engages a front locking projection 18A on the upper surface of the main body 15A. As a result, the male terminal 15 is locked in the cavity 33 while the tab 16 projects into the receptacle 32. The male terminal 15 is locked redundantly by the engagement of a retainer 37 with a rear locking projection 18B.

A lock 38 projects down at the front end of the ceiling surface of the receptacle 32 for engaging the locking hole 27 of the lock arm 26.

Figure 3:
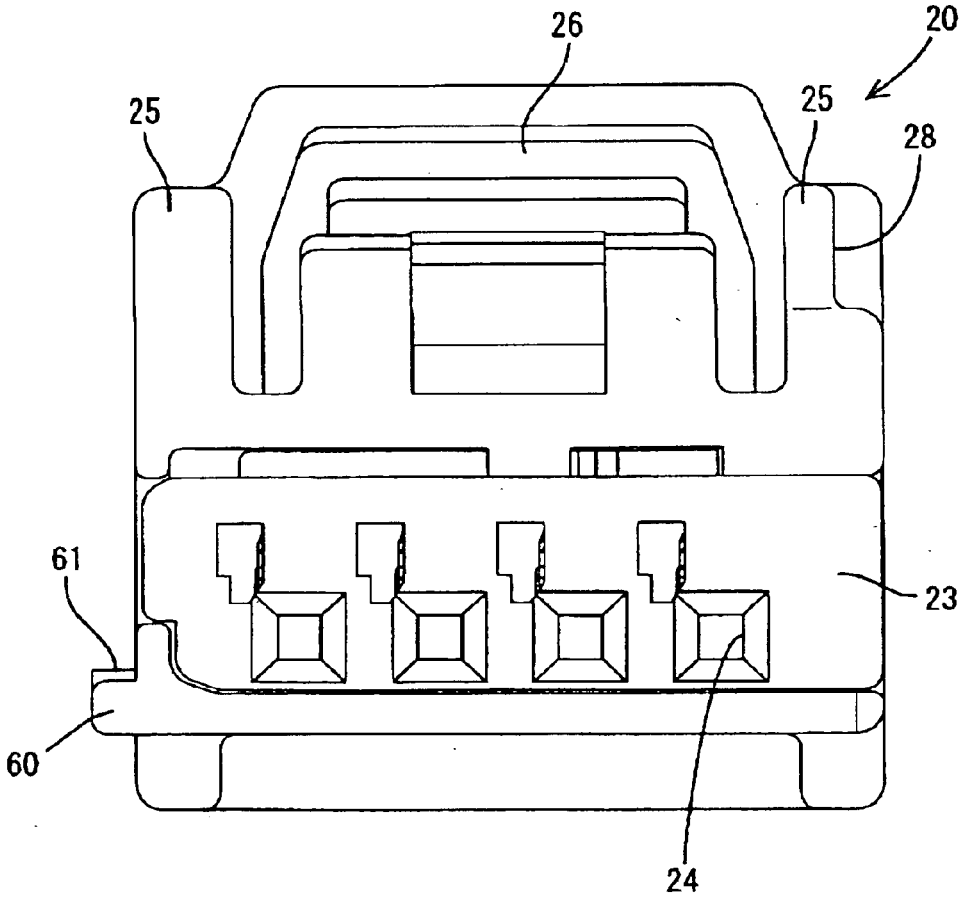
FIG. 3 is a front view of the female housing.

A rib 39 is provided at an upper end of the inner surface of the lateral wall of the receptacle 32 when viewed from front, as shown in FIG. 1, to prevent upside-down insertion. An escape groove 28 is formed in the outer surface of the right wall of the female housing 20 when viewed from the front for receiving the rib 39, as shown in FIG. 3.

A moving plate 40 is mounted on the front surface of the terminal accommodating portion 31 and also serves as the front walls of the cavities 33.

The moving plate 40 is made e.g. of a synthetic resin. As shown in FIGS. 4 to 7, the moving plate 40 is substantially rectangular in front view and is dimensioned to fit into an area of the receptacle 32 of the male housing 30 below the rib 39.

Through holes 41 extend through the moving plate 40 at locations that correspond to the cavities 33 of the male housing 30. Portions of the through holes 41 at the front surface of the moving plate 40 are dimensioned to closely receive the tabs 16. However, the through holes 41 gradually widen toward the rear surface of the moving plate 40.

Jig insertion openings 42 are formed at positions obliquely up and to the left from each through hole 41 when the moving plate 40 is viewed from the front. The jig insertion opening 42 can receive a jig for resiliently deforming the lock 35 to cancel the partial locking.

Figure 5:
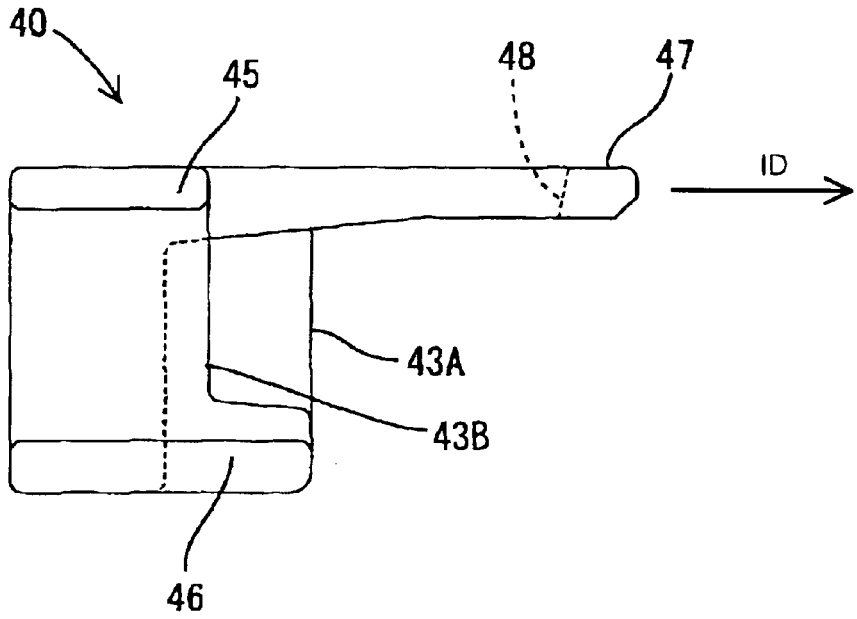
FIG. 5 is a side view of the moving plate.
Figure 6:
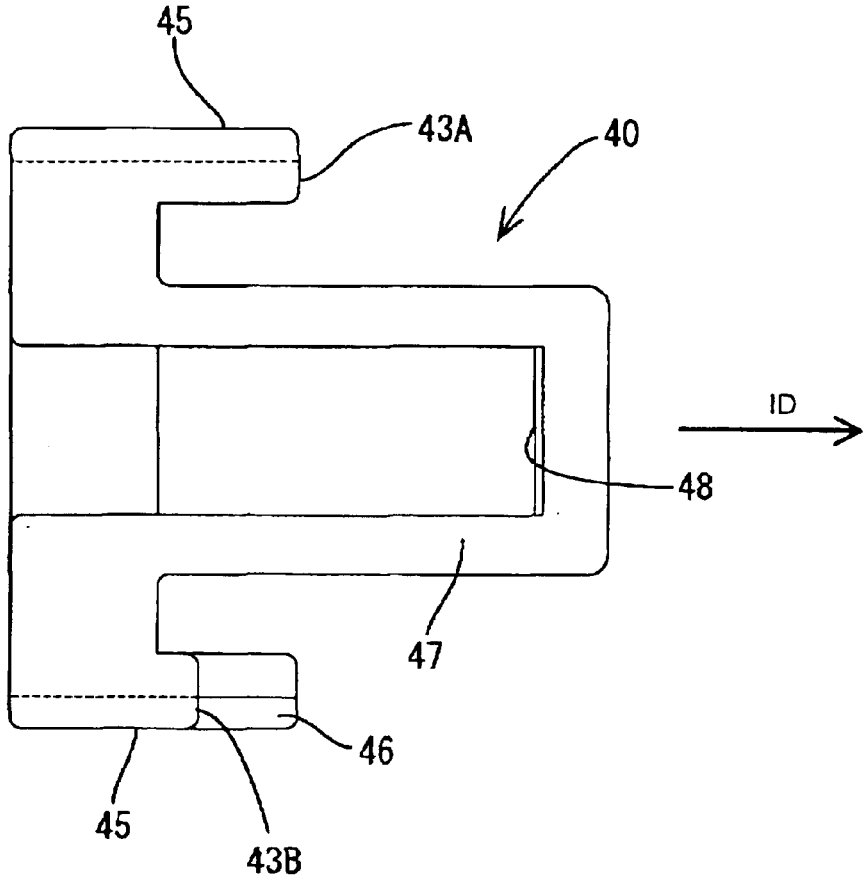
FIG. 6 is a plan view of the moving plate.

Projecting walls 43A, 43B are formed respectively at the left and right edges of the rear surface of the moving plate 40. As shown in FIGS. 5 and 6, the projecting wall 43A projects a long distance rearwardly over substantially its entire height, whereas the projecting wall 43B projects a long distance rearwardly only at its bottom.

Vertical grooves 50A, 50B are formed along the left and right edges of the back surface of the receptacle 32 and receive the left and right projecting walls 43A, 43B. The vertical grooves 50A, 50B have depths corresponding to the projecting distances of the corresponding projecting walls 43A, 43B.

Guide ribs 45, 46 extend forward and back along the connecting direction CD at upper and lower edges of the left and right surfaces of the moving plate 40. The guide ribs 45, 46 extend from the front surface (left surface in FIG. 5) to the projecting ends of the projecting walls 43A, 43B. As shown in FIG. 1, the upper guide ribs 45 have substantially square cross sections, whereas the lower guide ribs 46 have hooked, undercut or dovetail cross sections. The lower guide ribs 46 are slightly vertically longer than the upper guide ribs 45 and have upper surfaces that slope up to the outer side.

Guide grooves 51, 52 are formed at upper and lower positions of the inner surfaces of the left and right walls of the receptacle 32 in an insertion area for the moving plate 40. The guide grooves 51, 52 extend forward and back along the connecting direction CD from the opening edge of the receptacle 32 to the vertical grooves 50A, 50B in the back surface. The cross sections of the respective guide grooves 51, 52 correspond to the cross sections of the corresponding guide ribs 45, 46. More particularly, the upper guide grooves 51 have generally square cross sections with upper surfaces that slope moderately down towards the outer side. The lower guide grooves 52 have hooked, undercut or dovetail cross sections.

A resiliently deformable locking piece 47 is cantilevered rearwardly from the upper edge of the rear surface of the moving plate 40. The locking piece 47 slides in contact with the upper surface of the terminal accommodating portion 31 as the moving plate 40 is moved back in the receptacle 32. The locking piece 47 is formed with a locking groove 48 that is closed near the projecting end of the locking piece 47.

Partial locking projections 54 are provided at the front end of the upper surface of the terminal accommodating portion 31 of the male housing 30 and a full locking projection 55 is provided rearward of the partial locking projections 54 by a specified distance. The locking projections 54, 55 are formed to engage the locking groove 48.

Each partial locking projection 54 has a slanted front guide surface aligned at a large obtuse angle to the upper surface of the terminal-accommodating portion 31 and to the connecting direction CD. Each partial locking projection 54 also has an overhanging or undercut rear locking surface aligned at an acute angle to the upper surface of the terminal-accommodating portion 31 and to the connecting direction CD. The full locking projection 55 also has a slanted front guide surface aligned at a large obtuse angle to the upper surface of the terminal-accommodating portion 31 and to the connecting direction CD. The rear surface of the full locking projection 55 also has a slanted rear guide surface aligned at a sufficiently steep obtuse angle to the upper surface of the terminal-accommodating portion 31 to define a semi-locking construction.

The moving plate 40 has a partial locking position, shown in FIG. 2, where the locking groove 48 engages the partial locking projections 54 and with the leading end of the locking piece 47 between the partial and full locking projections 54, 55. At this partial locking position, leading ends of the tabs 16 project slightly forward from the corresponding through holes 41.

Figure 10:
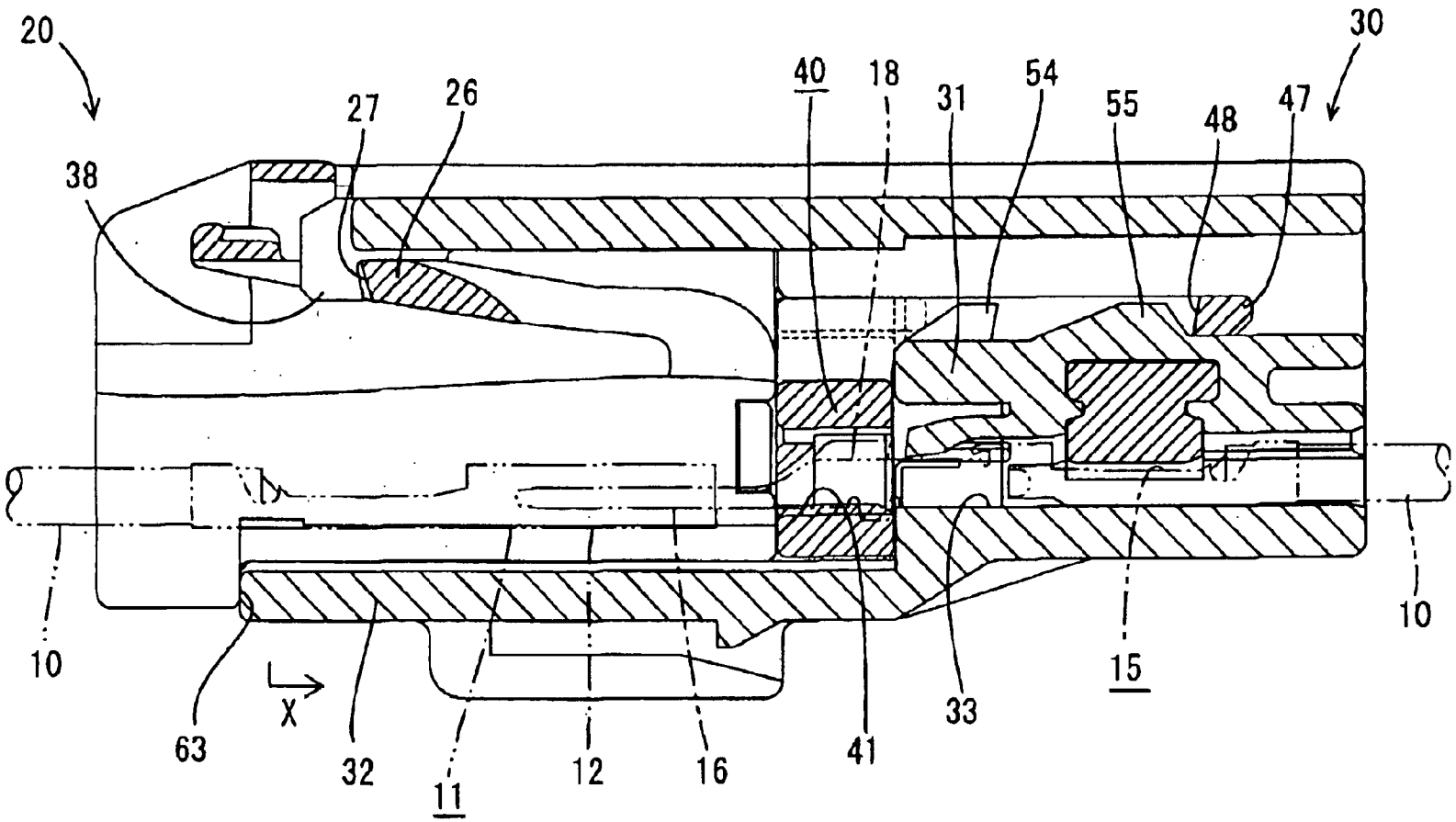
FIG. 10 is a longitudinal section after complete connection.

The moving plate 40 also has a full locking position, as shown in FIG. 10, where the locking groove 48 of the locking piece 47 engages the full locking projection 55. The moving plate 40 at the full locking position is held in contact with the front surface of the terminal-accommodating portion 31.

Figure 8:
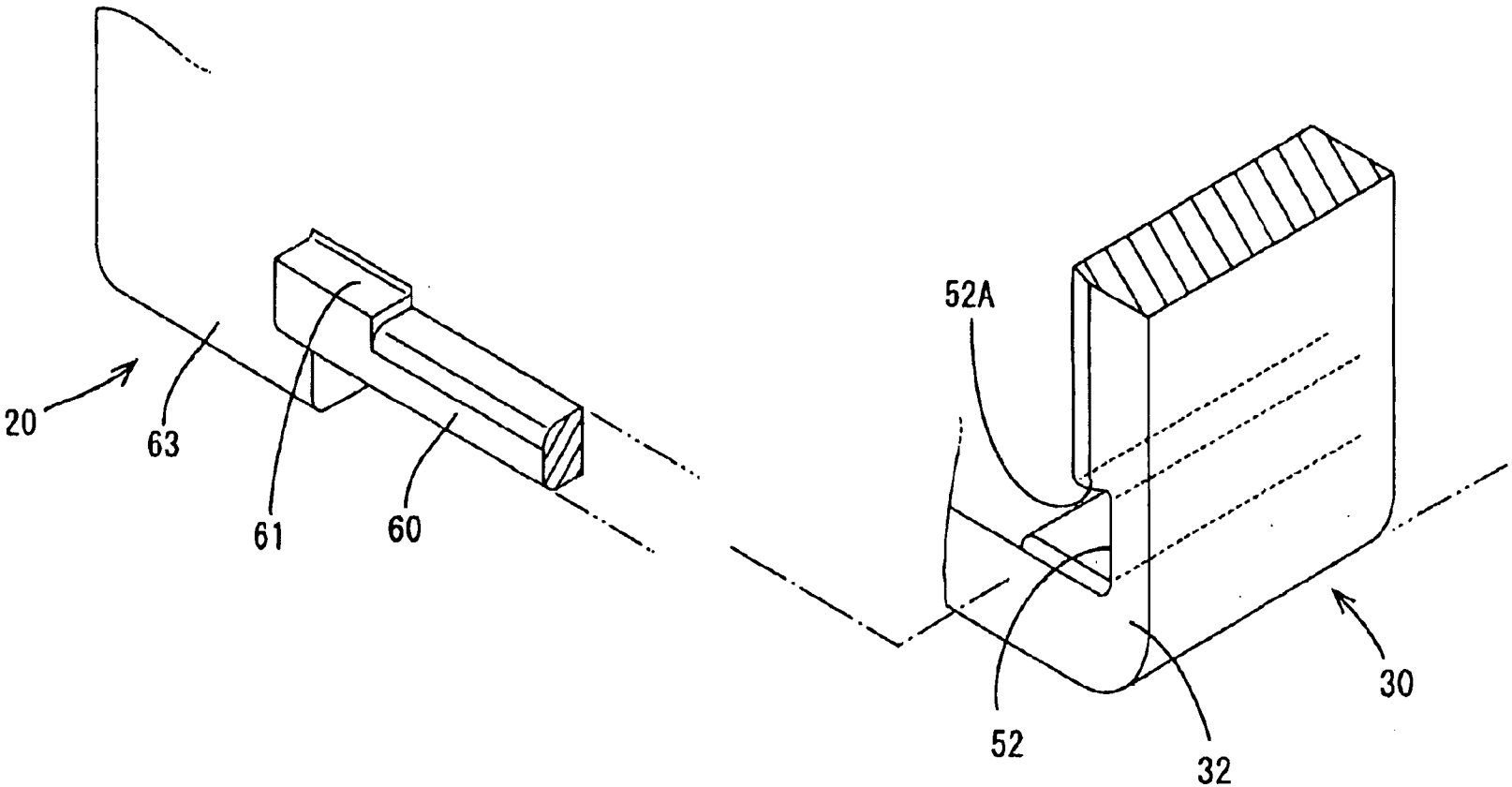
FIG. 8 is a partial perspective view showing the shape of an auxiliary rib of the female housing.
Figure 11:
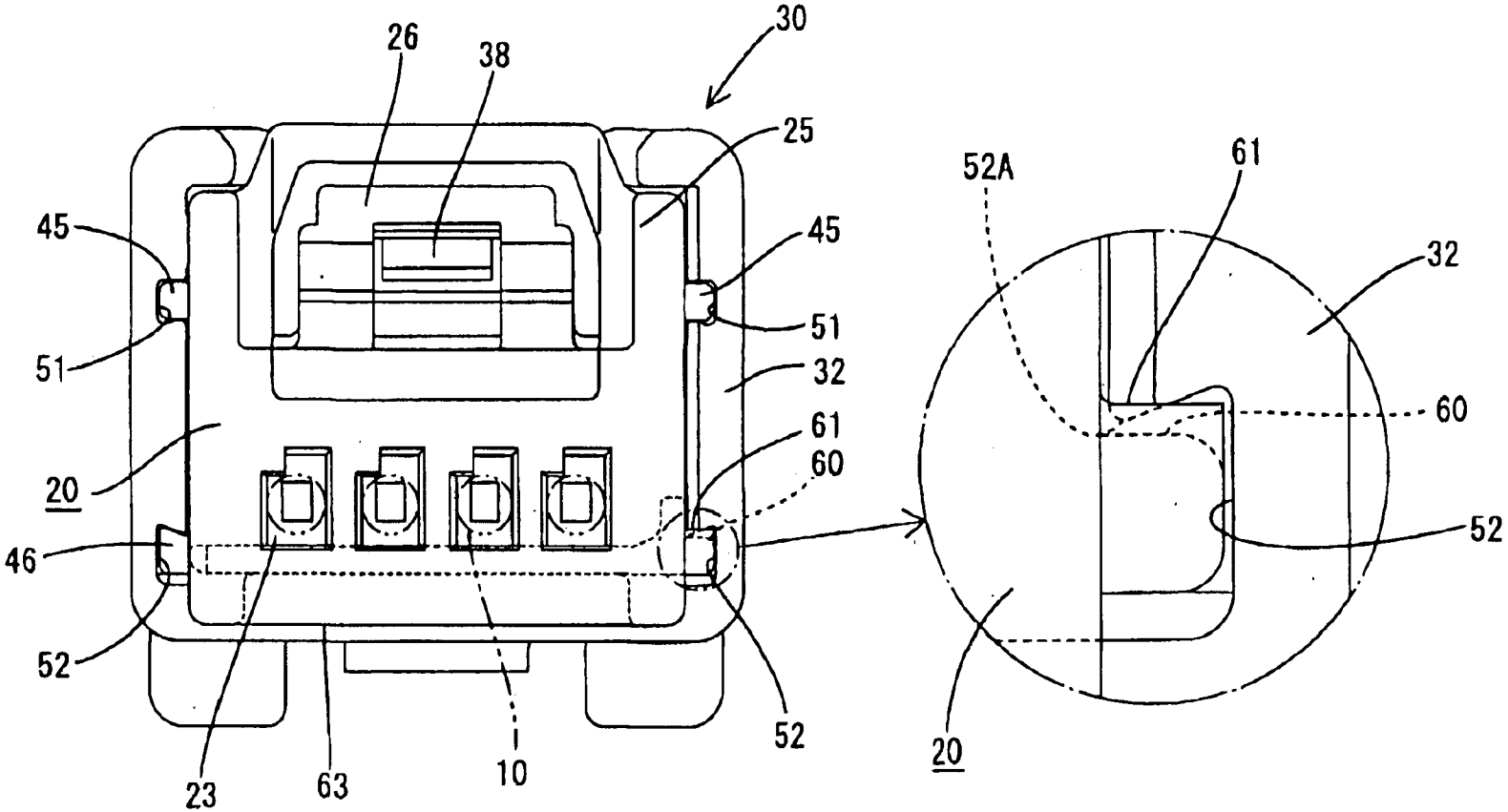
FIG. 11 is a front view after complete connection.

An auxiliary rib 60 is formed at the bottom edge of the left surface of the female housing 20 when viewed from the front. The auxiliary rib 60 extends forward and back along the connecting direction CD from the front edge of the female housing 20 to a position slightly before the rear end of the female housing 20, as shown in FIGS. 2 and 3. The auxiliary rib 60 has a substantially rectangular cross section and can be slid into the guide groove 52 at the lower right of the receptacle 32 of the male housing 30. However, as shown in FIG. 8, the rear end of the auxiliary rib 60 has a slightly enlarged cross-section to form a shake-preventing portion 61 that abuts an upper inner end edge 52 of the guide groove 52, as shown in FIG. 11.

A stopper 63 is formed at the rear end of the bottom surface of the female housing 20 and abuts the bottom edge of the receptacle 32 when the female housing 20 is fit into the receptacle 32 by a specified distance.

The female terminals 11 are inserted into the cavities 12 of the female housing 20 and are locked doubly by the locks and the retainer 23.

The guide ribs 45, 46 on the side surfaces of the moving plate 40 are aligned with the guide grooves 51, 52 on the inner surfaces of the receptacle 32. The moving plate 40 then is inserted into the receptacle 32 in an inserting direction ID, as shown by the arrow in FIG. 4. The moving plate 40 could be upside down prior to insertion. However, the dovetail guide ribs 46 would be located at the upper side. Thus, the pointed leading portions of the dovetail guide ribs 46 would contact the opening edge of the square guide groove 51 to prevent insertion and to detect the upside-down orientation.

Figure 7:
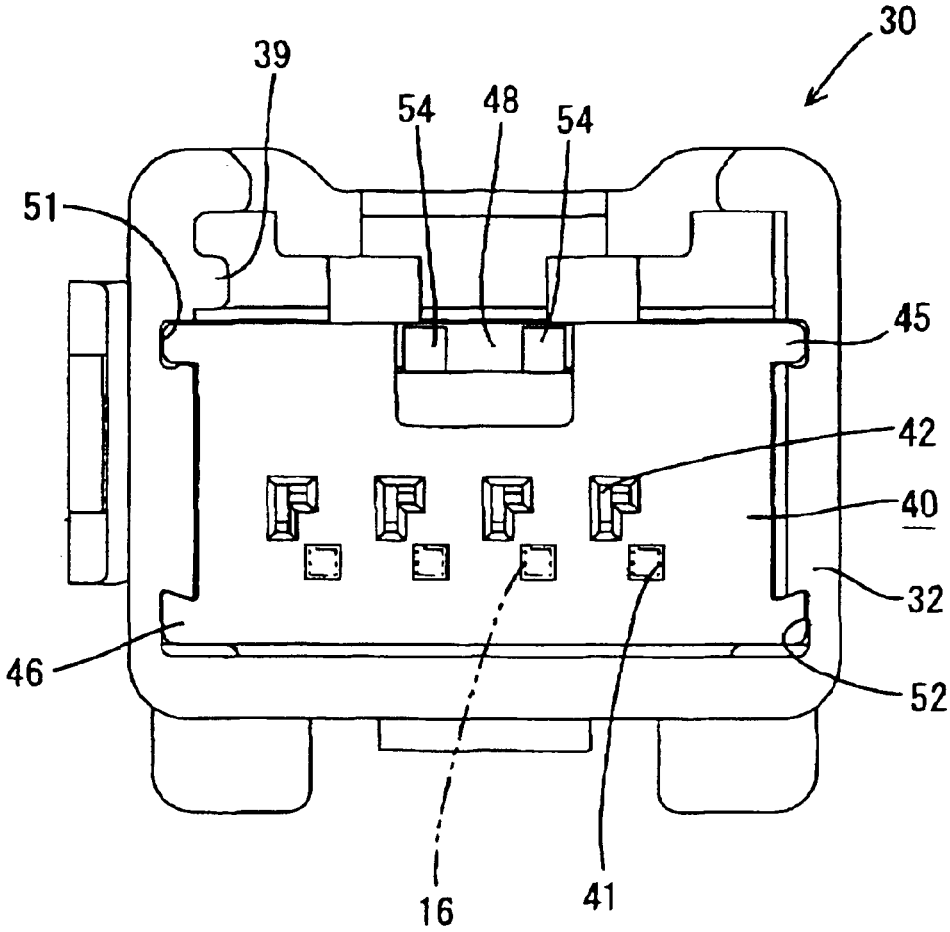
FIG. 7 is a front view showing a state where the moving plate is mounted at a partial locking position.

The properly oriented moving plate 40 can be pushed in the inserting direction ID toward the back of the receptacle 32 while the guide ribs 45, 46 are slid in the corresponding guide grooves 51, 52, as shown in FIG. 7. The guide ribs 45, 46 and the guide grooves 51, 52 are engaged at the four corners of the moving plate 40, and the guide ribs 46 and the guide grooves 52 with the hooked cross section engage at the two lower positions. Thus, the moving plate 40 is pushed substantially straight to back without shaking about a longitudinal axis or in a meandering manner.

The leading end of the locking piece 47 contacts the partial locking projections 54 when the moving plate 40 is pushed by a specified distance. The moving plate 40 then is pushed further and the locking piece 47 resiliently deforms and moves over the partial locking projections 54. The engagement of the guide ribs 45, 46 and the guide grooves 51, 52 prevents the moving plate 40 from tilting when the locking piece 47 engages the partial locking projections 54. The moving plate 40 then is pushed further. As a result, the leading end of the locking piece 47 passes the partial locking projections 54 and the locking piece 47 is restored resiliently so that the locking groove 48 engages the partial locking projections 54. Thus, the moving plate 40 is held at the partial locking position (see FIG. 2).

In this state, the male terminals 15 are inserted into the corresponding cavities 33 and are locked partially by the locks 35. The leading ends of the tabs 16 of the male terminals 15 pass through the through holes 41 of the moving plate 40 and project slightly forward from the front surface of the moving plate 40, as shown in dotted line in FIG. 2. The male terminals 15 then are locked redundantly by the retainer 37.

The assembled female and male housings 20, 30 are caused to face each other as shown in FIG. 2. The female housing 20 then is inserted along the connecting direction CD into the receptacle 32, as shown by an arrow in FIG. 2. The female housing 20 could be held upside down. As a result, a part of the front surface of the female housing 20 other than the escape groove 28 contacts the rib 39 and prevents the female housing 20 from being pushed any further. Thus, the improperly oriented female housing 20 cannot be inserted.

The properly oriented female housing 20 can be fit into the receptacle 32. More particularly, the rib 39 enters the escape groove 28 and the auxiliary rib 60 on the female housing 20 enters the corresponding guide groove 52 of the receptacle 32.

Figure 9:
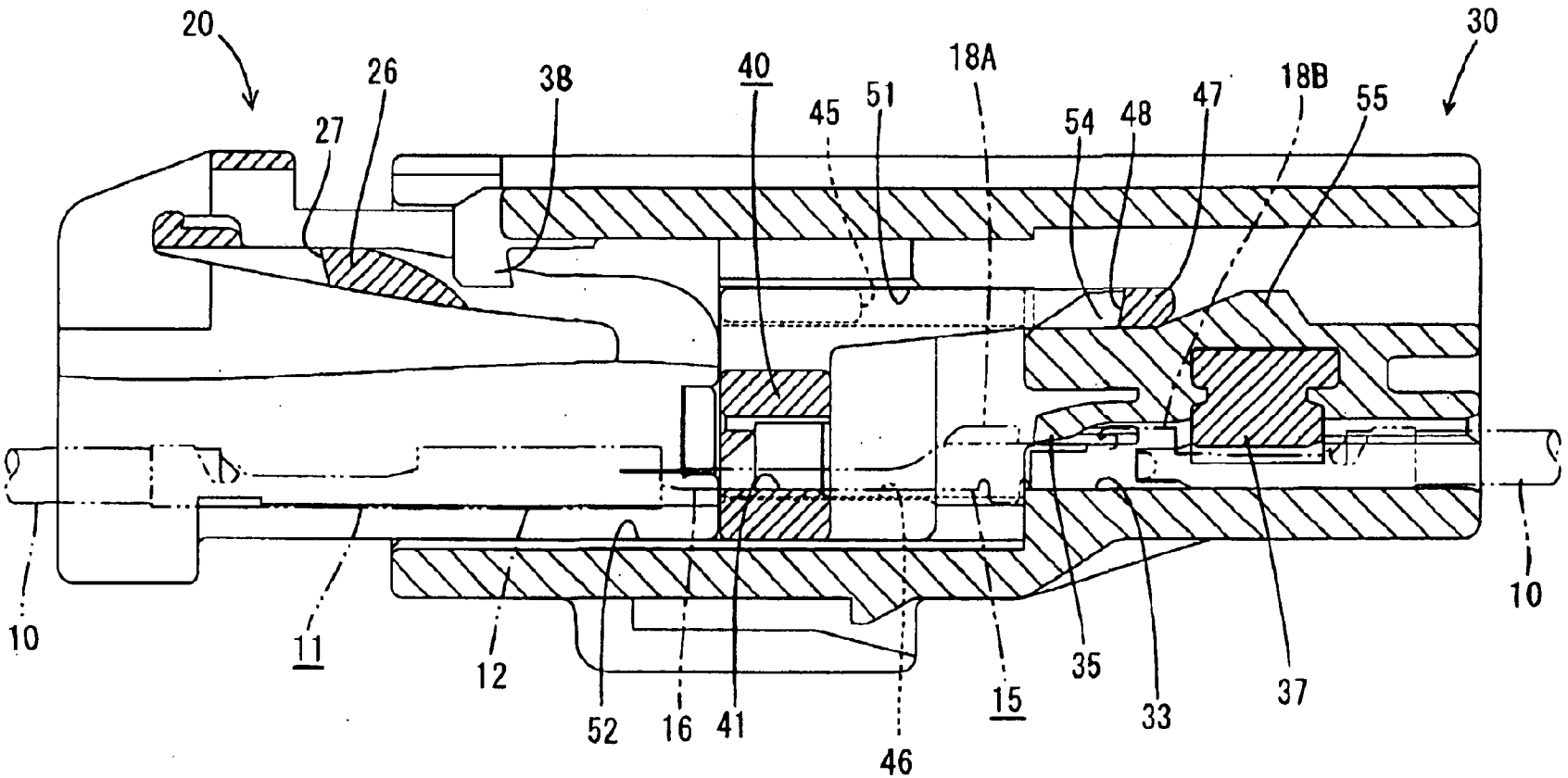
FIG. 9 is a longitudinal section showing an intermediate stage of a connecting operation of the male and female housings.

The female housing 20 is pushed by a sufficient distance to contact the front surface of the moving plate 40, as shown in FIG. 9. Additionally, the leading ends of the tabs 16 project through the terminal insertion openings 24 of the retainer 23 and into the cavities 22. The leading ends of the tabs 16 are aligned in substantially straight postures by passing through the corresponding through holes 41 of the moving plate 40, and thus can be inserted precisely through the mating terminal insertion openings 24.

The female housing 20 is pushed further, and moves the moving plate 40 to the back side. Simultaneously, the locking piece 47 is pushed and undergoes a resilient deformation to move over the full locking projection 55. The moving plate 40 is guided by the engagement of the guide ribs 45, 46 and the guide grooves 51, 52, and is moved without being inclined. In the meantime, the tabs 16 of the male terminals 15 are held straight by the through holes 41 of the moving plate 40 and enter the cavities 22 more deeply. Thus, the tabs 16 of the male terminals 15 are connected gradually with the connecting portions 12 of the mating female terminals 11. The lock arm 26 also is pushed and resiliently deforms.

The shake-preventing portion 61 at the rear end of the auxiliary rib 60 of the female housing 20 abuts the inner end edge 52A of the guide groove 52 at a final stage of the connection of the female housing 20, as shown in FIG. 11. The female housing 20 then is pushed further so that shake-preventing portion 61 is pressed into the guide groove 52 and squashes the end edge 52A over a specified area.

The leading end of the locking piece 47 passes the full locking projection 55 as the moving plate 40 contacts the front surface of the terminal-accommodating portion 31. As a result, the locking piece 47 is restored resiliently and the locking groove 48 engages the full locking projection 55, as shown in FIG. 10. Thus, the moving plate 40 is held at the full locking position.

During this time, the tabs 16 of the male terminals 15 project a specified distance from the front surface of the moving plate 40 while being held substantially straight, and are connected properly with the connecting portions 12 of the mating female terminals 11. Further, the moving plate 40 forms the front walls of the cavities 33 and the portions of the male terminals 15 from the base ends of the tabs 16 to the front locking projections 18A are fit and supported in the through holes 41.

The stopper 63 contacts the bottom end of the receptacle 32 when the housings 20, 30 reach their properly connected state to prevent the female housing 20 from being pushed any further. At this time, the lock projection 38 reaches the lock hole 27 of the lock arm 26. Thus, the lock arm 26 is restored resiliently and the lock projection 38 fits in the locking hole 27 to lock the female and male housings 20, 30 in their properly connected state.

Figure 12:
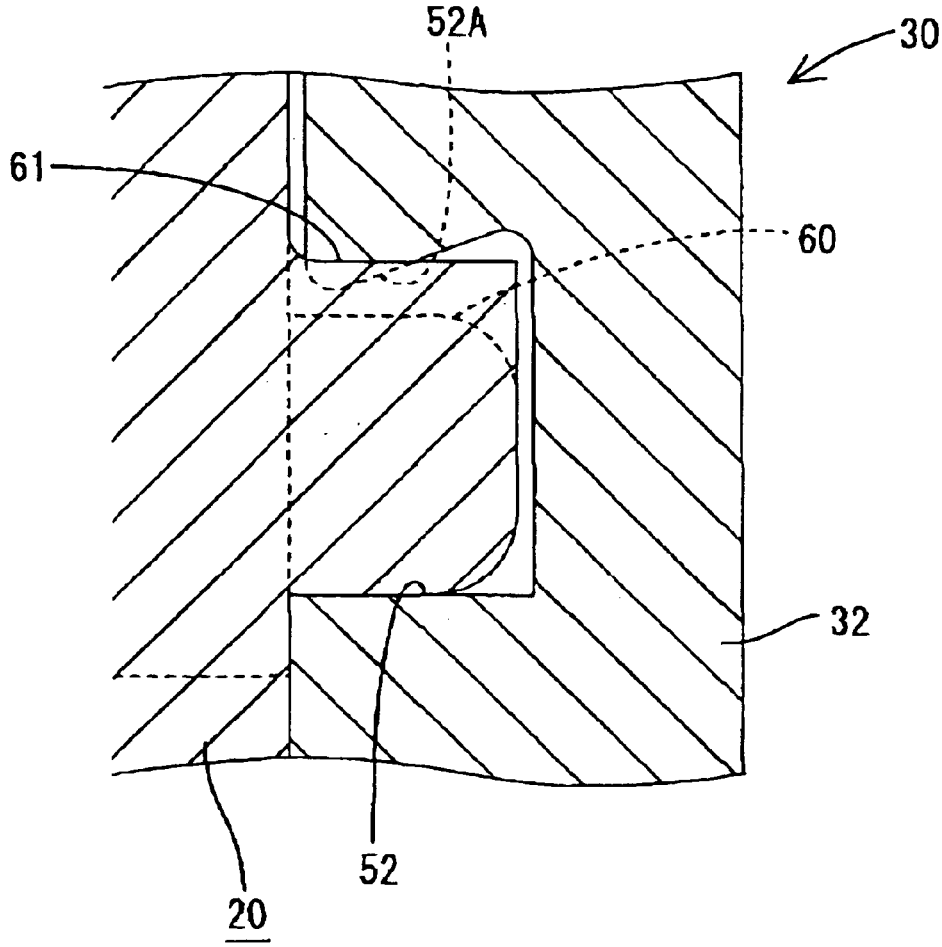
FIG. 12 is an enlarged section along 12-12 of FIG. 10.

As shown in FIG. 12, the shake-preventing portion 61 of the auxiliary rib 60 of the female housing 20 is pressed into the corresponding guide groove 52. Thus, the female and male housings 20, 30 are prevented from shaking along the connecting direction CD and at an angle to the connecting direction CD, thereby advantageously preventing abrasion caused by fine sliding motions of the female and male terminals.

Figure 13:
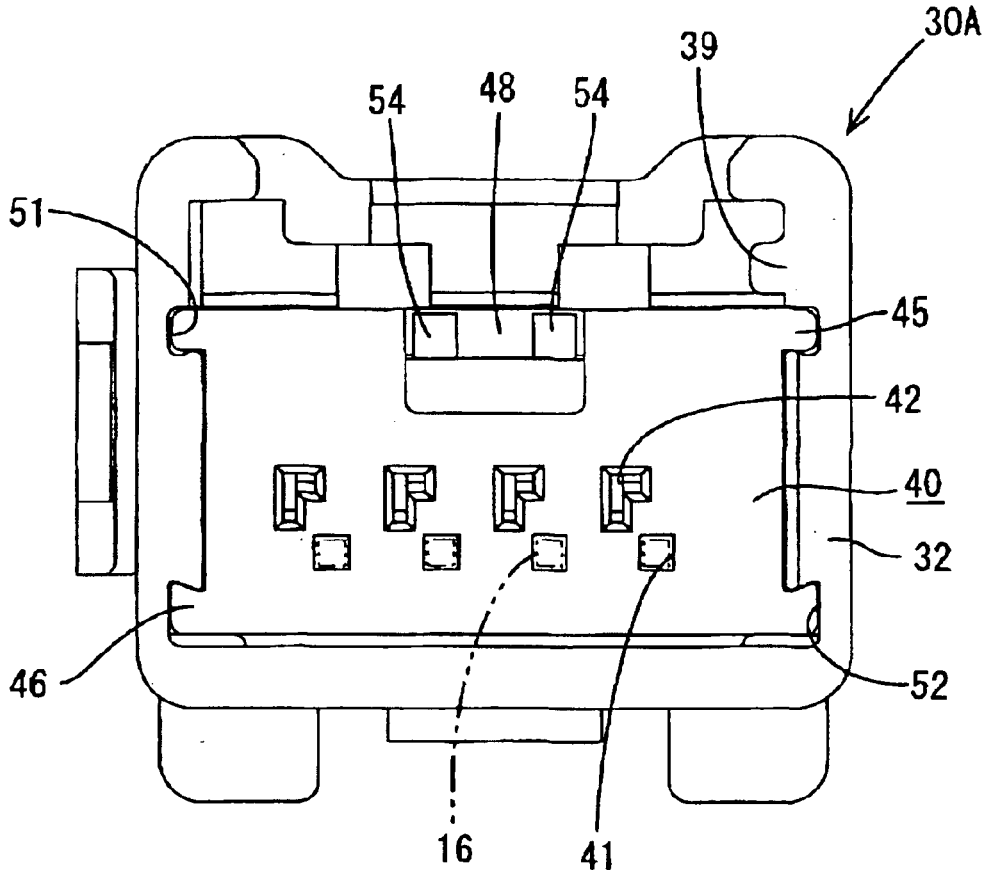
FIG. 13 is a front view of a male housing in which an upside-down insertion preventing rib is provided at a different position.
Figure 14:
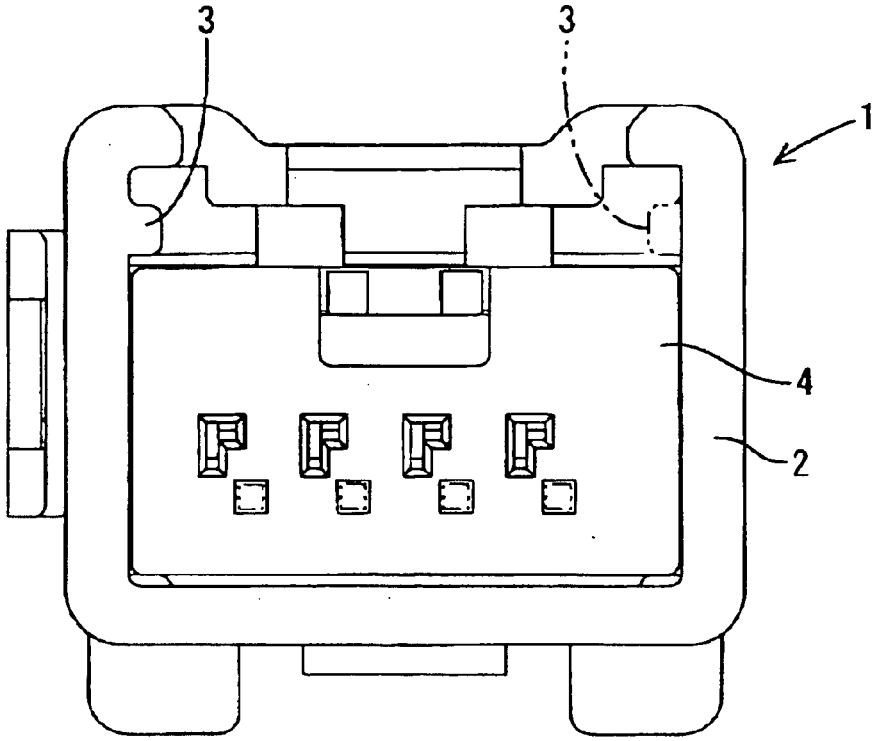
FIG. 14 PRIOR ART
FIG. 14 is a front view of a prior art connector.

The moving plate 40 has such a cross section obtained as if by cutting off an upper part of the cross section of the receptacle 32 of the male housing 30 as described above. Thus, the moving plate 40 also can be used for a male housing 30A where a rib 39 for preventing an improper insertion is provided, for example, at an upper end of the inner surface of the right wall of the receptacle 32 when viewed from front as shown in FIG. 13.

The guiding means extends forward and back along the connecting direction CD and has guide ribs 45, 46 and guide grooves 51, 52 between the moving plate 40 and the receptacle 32. Thus, the moving plate 40 can be moved smoothly without shaking. This makes an operation of mounting the moving plate 40 easier and enables the moving plate 40 to fulfill its function of connecting the two housings 20, 30 while holding the tabs 16 of the male terminals 15 aligned.

The guide ribs 46 and guide grooves 52 at the lower side have a hooked or undercut cross section. Thus, the moving plate 40 can be pushed substantially straight to the back side of the receptacle 32 without shaking along the longitudinal axis or in a meandering manner.

The moving plate 40 could be inserted improperly. However, the hooked guide ribs 46 contact the opening edges of the guide grooves 51 that have a different, non-complementary cross section. Thus, the insertion is prevented and an upside-down insertion is detected.

The shake-preventing portion 61 of the auxiliary rib 60 of the female housing 20 is pressed into the mating guide groove 52 at the final stage of the connecting operation and squashing the end edge 52A. Thus, the housings 20, 30 cannot shake, and abrasion due to fine sliding motion of the terminal fittings 11, 15 is prevented. The shake-preventing portion 61 is pressed only at the final stage of connection. Thus, shake prevention is achieved while a force required to connect the housings 20, 30 is suppressed to as low a level as possible.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The guide grooves may be formed in the moving plate and the guide ribs may be on the inner peripheral surfaces of the receptacle.

The shake-preventing portion may be provided by narrowing the groove at the rear end with respect to the connecting direction CD.

The moving plate also serves as the front walls of the cavities in the foregoing embodiment. However, the invention is widely applicable to connectors in general that have a front-stop with a function of stopping terminals at their front limit positions, a front retainer having a function of doubly locking terminal fittings upon being inserted from front, or any separate front member mounted on the front surface of a terminal accommodating portion at the back side of a receptacle of a connector housing.

What is claimed is:

1. A connector, comprising:

a housing having a terminal accommodating portion with opposite front and rear ends and cavities extending between the ends for receiving terminal fittings along a connecting direction, a receptacle surrounding the front end of the terminal accommodating portion;

a separate front member having opposite front and rear faces and being insertable along an inserting direction into the receptacle until the rear face of the front member substantially abuts the front end of the terminal accommodating portion;

a resiliently deflectable lock formed on at least one of the housing and the front member and at least one locking projection provided on the other of the housing and the front member, the resiliently deflectable lock being engageable with the locking projection to hold the front member in at least one selected position relative to the housing; and guiding means between the front member and the receptacle and spaced from the resilient lock and the locking projection for guiding the front member into the receptacle substantially parallel with the connecting direction and preventing misalignment in response to forces generated when the resilient lock engages the locking projection, the guiding means comprising a plurality of pairs of ribs and grooves, the ribs, the grooves, the resiliently deflectable lock and the locking projection all being disposed relative to one another so that the ribs and the grooves engage one another before the resiliently deflectable lock engages the locking projection for preventing the moving plate from tilting when the lock engages the locking projection, the rib and the groove in a first of said pairs having a cross section different from a rib and groove in a second of said pairs to ensure connection in only one orientation.

2. The connector of claim 1, wherein the separate front member is configured to form at least part of front ends of the cavities.

3. The connector of claim 1, wherein the guiding means comprises at least one rib and at least one groove formed on opposed facing surfaces of the front member and the receptacle and slidably engageable with each other.

4. The connector of claim 1, further comprising a mating housing fittable into the receptacle of the housing.

5. The connector of claim 4, wherein the mating housing has a rib or a groove slidably engageable with one of the guiding means in the receptacle.

6. The connector of claim 5, wherein a shake-preventing portion is disposed on at least one of the housing and the mating housing spaced from the resilient lock and the locking projection for becoming active towards the end of an insertion stroke of the mating housing into the receptacle.

7. The connector of claim 6, wherein the shake-preventing portion is provided at a rear end of the rib or groove of the mating housing with respect to an inserting direction.

8. The connector of claim 1, wherein the housing is a male housing with cavities for receiving male terminals so that tabs of the male terminals project into the receptacle, and the front member is a moving plate formed with through holes through which the tabs can be passed.

9. The connector of claim 8, wherein the moving plate is locked in the receptacle with leading ends of the tabs located in the corresponding through holes and being moved rearward in the receptacle as a mating female housing is fit into the receptacle.

10. A connector, comprising:

a male housing having a terminal accommodating portion with opposite front and rear ends and cavities extending between the ends for receiving male terminal fittings along connecting direction, a receptacle surrounding the front end of the terminal accommodating portion;

a moving plate inserted along an inserting direction into the receptacle and towards the front end of the terminal accommodating portion, the moving plate having holes aligned respectively with the cavities;

a resilient deflectable lock formed on at least one of the male housing and the moving plate and at least one locking projection provided on the other of the male housing and the moving plate, the resiliently deflectable lock being engagable with the locking projection to hold the moving plate in at least one specify position relative to the male housing;

male terminal fittings inserted in the cavities and having tabs projecting through the holes of the moving plate; and ribs and grooves farmed on opposed facing surfaces of the front plate and the receptacle and slidably engageable with each other for guiding the front plate into the receptacle substantially parallel with the connecting direction, the ribs and grooves having cross sectional shapes for preventing inverted insertion of the moving plate into the receptacle, wherein the ribs, the grooves, the resiliently deflectable lock and the locking projection all are disposed relative to one another so that the ribs and the grooves engage one another before the resiliently deflectable lock engages the locking projection for preventing the moving plate from tilting when the lock engages the locking projection.

11. The connector of claim 10, wherein the front plate is configured to form parts of front ends of the cavitles.

12. The connector of claim 10, further comprising a female housing fittable into the receptacle of the male housing.

13. The connector of claim 12, wherein the female housing has a rib slidably engageable with one of the grooves in the receptacle.

14. The connector of claim 12, wherein the moving plate is locked in the receptacle with leading ends of the tabs located in the corresponding through holes and being moved rearward in the receptacle as the female housing is fit into the receptacle.

15. The connector of claim 12, wherein a shake-preventing portion is disposed on at least one of the male housing and the female housing for becoming active towards the end of an insertion stroke of the female housing into the receptacle.

16. The connector of claim 15, wherein the shake-preventing portion is provided at a rear end of the rib of the female housing with respect to an inserting direction.

* * * * *